US011800911B2

(12) United States Patent
Govea Suarez et al.

(10) Patent No.: US 11,800,911 B2
(45) Date of Patent: Oct. 31, 2023

(54) RADIAL WATCH

(71) Applicant: Steve Govea Suarez, Fountain, CO (US)

(72) Inventors: Steve Govea Suarez, Fountain, CO (US); Jeremy Irons, Venice, CA (US)

(73) Assignee: Steve Govea Suarez, Fountain, CO (US)

( * ) Notice: Subject to any disclaimer, the term of this patent is extended or adjusted under 35 U.S.C. 154(b) by 66 days.

(21) Appl. No.: 17/696,008

(22) Filed: Mar. 16, 2022

(65) Prior Publication Data

US 2022/0322796 A1 Oct. 13, 2022

Related U.S. Application Data

(60) Provisional application No. 63/173,553, filed on Apr. 12, 2021.

(51) Int. Cl.
*A44C 5/00* (2006.01)
*G04B 37/14* (2006.01)
(Continued)

(52) U.S. Cl.
CPC ..... *A44C 5/0061* (2013.01); *A44C 5/145* (2013.01); *A44C 5/2019* (2013.01); *G04B 37/1493* (2013.01)

(58) Field of Classification Search
CPC ..... A44C 5/0061; A44C 5/145; A44C 5/2018; A44C 5/0084; A44C 5/0092; A44C 5/12; A44C 5/14; A44C 5/147; G04B 37/1493
(Continued)

(56) References Cited

U.S. PATENT DOCUMENTS 2,226,138 A 12/1940 Eugen
2,707,800 A 5/1955 Emil
(Continued)

FOREIGN PATENT DOCUMENTS

CN 105942679 B 11/2017
DE 1098755 B 2/1961
(Continued)

OTHER PUBLICATIONS

"08—Jewelry-New, Zuni Watch Cuff, Hallmarked "JRB": Clock Face to the Side, Coral, Jet, Turquoise (4.75" + 0.75" gap)" Publisher: Len Wood's Indian TerritoryURL link: https://www.navajorugsindianbaskets.com/artist/_08%20-%20Jewelry-New/types/W_-_ Watch_Bands_and_Watch_Bracelets/8007#!8007 Accessed Feb. 4, 2021.
"Baum & Mercier Gold Plated Hinge Bracelet Wristwatch" https://www.ebth.com/items/6168975-baum-mercier-gold-plated-hinge-bracelet-wristwatch Accessed Mar. 15, 2022.
(Continued)

*Primary Examiner* — Jack W Lavinder
(74) *Attorney, Agent, or Firm* — Argus Intellectual Enterprise; Jordan Sworen; Daniel Enea

(57) ABSTRACT

A wristwatch having a watch case that rests against the radial side of a wearer's wrist is provided. The wristwatch includes a radial watch having a rigid band with a first and second end that forms a gap. A watch case is secured between the ends forming a closed loop. The rigid band is monolithic and sized in such a way that the watch case is disposed on the radial side of the wrist when worn. The watch case includes a face that can be oriented towards the wearer for convenient viewing. In one embodiment, the band includes padding on an interior side.

11 Claims, 8 Drawing Sheets

(51) Int. Cl.

| | |
|---|---|
| ***G04B 37/18*** | (2006.01) |
| ***A44C 5/20*** | (2006.01) |
| ***A44C 5/14*** | (2006.01) |

(58) Field of Classification Search
USPC ..... 368/282
See application file for complete search history.

(56) References Cited

U.S. PATENT DOCUMENTS

| | | | | |
|---|---|---|---|---|
| 2,765,108 | A | 10/1956 | Albert | |
| 2,820,275 | A | 1/1958 | Ralph | |
| 2,823,524 | A | 2/1958 | Norman | |
| 3,032,651 | A | 5/1962 | Josef et al. | |
| 4,060,185 | A * | 11/1977 | Kuroda | A44C 5/147 63/11 |
| 4,575,833 | A | 3/1986 | Bakhtiari | |
| 4,879,702 | A | 11/1989 | Gardner | |
| 5,068,840 | A | 11/1991 | Buckner | |
| 7,017,368 | B2 | 3/2006 | Hug | |
| 10,537,157 | B2 | 1/2020 | Partheban et al. | |
| 10,716,370 | B2 | 7/2020 | Bayley et al. | |
| 2003/0116596 | A1 | 6/2003 | Terasawa | |
| 2005/0083788 | A1 * | 4/2005 | Ogletree | A44C 5/0069 368/282 |

FOREIGN PATENT DOCUMENTS

| | | | |
|---|---|---|---|
| DE | 19719437 | A1 | 11/1998 |
| FR | 2098693 | A6 * | 7/1977 |
| FR | 2617614 | A1 | 1/1989 |
| JP | H09101379 | A | 4/1997 |
| WO | 1990012347 | A1 | 10/1990 |

OTHER PUBLICATIONS

"Black Snake Style Band Slim Case Eikon Women's Bangle Cuff Watch" https://www.amazon.com/dp/B015R1507YFTW Accessed Mar. 15, 2022.

"Chico's Silver Tone Spring Hinge Bracelet Band Analog Wristwatch"Publisher: Lot-ArtURL link: https://www.lot-art.com/auction-lots/Chicos-Silver-Tone-Spring-Hinge-Bracelet-Band-Analog-Wristwatch/17cin659m637-chico_silver_tone-26.11.17-ebth Accessed Feb. 4, 2021.

"Cito: An Actuated Smartwatch for Extended Interactions" http://library.usc.edu.ph/ACM/CHI%202017/1proc/p5331.pdf, Gong, J., Li, L. Vogel, D., Yang, X.-D. Accessed Mar. 15, 2022.

"New Women's Watch With Spring Hinge Bracelet"Publisher: lordecorURL link: https://poshmark.com/listing/New-Womens-Watch-With-Spring-Hinge-Bracelet-5a0f8d0b620ff78d03002fcf Accessed Feb. 4, 2021.

"Rosemarie & Jubalee Women's Two Toned Textured Square Face Caviar Style Hinged Cuff Bracelet Watch" https://www.amazon.com/dp/B07NQW43H7 Accessed Mar. 15, 2022.

"Ventura Sparc MGS Watch" https://www.watchpro.com/tech-spot-ventura-sparc-mgs/ Accessed Mar. 15, 2022.

"Vintage Sterling Silver, Turquoise and Coral Side Mount Watch Cuff"Publisher: Horsekeeping LLCURL link: https://www.horsekeeping.com/jewelry/pawn/watches/W301-cuff-side-turq-coral-712.htm Accessed Feb. 4, 2021.

"Vision90° —LED Watch Concept" https://blog.tokyoflash.com/2010/09/30/vision90-led-watch-concept/ Tokyoflash Japan Product Design Studio Accessed Mar. 15, 2022.

"Wincci Red Hinged Cuff Bangle Bracelet Analog Quartz New Battery Run Woman Watch" https://www.ebay.com/itm/Wincci-Red-Hinged-Cuff-Bangle-Bracelet-Analog-Quartz-New-Battery-Run-Woman-Watch-/363216160736.

* cited by examiner

RADIAL WATCH

CROSS REFERENCE TO RELATED APPLICATION

This application claims the benefit of U.S. provisional application No. 63/173,553 filed on Apr. 12, 2021. The above identified patent application is herein incorporated by reference in its entirety.

BACKGROUND OF THE INVENTION

The present invention relates to wrist watches. The present invention further provides a wristwatch configured to only be worn of the wrist having the watch case rest against the radial side of a wrist, such that the band cannot rotate once positioned on the wrist.

Conventional watches are constructed such that the watch face is positioned on the dorsal surface of the wrist. Wearing a watch on the dorsal surface of the wrist requires a wearer to rotate the wrist in order to bring the dial or face in line with wearer's eye line. This rotational movement is difficult and unnatural for certain individuals with limited wrist or arm mobility. Additionally, having to glance downward while rotating the wrist requires a wearer to avert their eyes for a few seconds. The glance can distract a wearer longer than needed or safe if a wearer is engaging in an activity requiring their complete attention, such as driving or a high intensity sport.

Further, the band of the watch is typically flexible such that the face can be rotated around the wrist, especially if the band is loose. This allows a person to rotate the face such that it is on the radial side of the wrist, however, it will just as easily rotate other positions along the wrist requiring continuous readjustment. The wrist generally comprises an elliptical cross section having longer palm and dorsal sides. The watch case is typically heavier than the band and during usage tends to hang from the wrist regardless of orientation. Some watch bands are fitted to the wrist by adjusting the length of band to minimize movement from the desired position. However, the size of the watch case is often larger than the radial and ulnar sides of the wrist thereby requiring the band to constrict the wrist to stay in that desired position.

Some devices exist that are capable of being worn on a side of the wrist. However, these devices have a band capable of rotating around the wrist while the watch is worn or are difficult to fasten and unfasten to the wrist of the wearer. Therefore, there exists a need for a watch band configured to receive and retain a watch face along a radial side of a wrist when worn thereon, such that the watch band is adapted to not rotate when secured thereto.

In light of the devices disclosed in the known art, it is submitted that the present invention substantially diverges in design elements and methods from the known art and consequently it is clear that there is a need in the art for an improvement for a radial watch. In this regard the instant invention substantially fulfills these needs.

SUMMARY OF THE INVENTION

In view of the foregoing disadvantages inherent in the known types of watch bands now present in the known art, the present invention provides a new watch band wherein the same can be utilized for positioning the watch face on a radial side of the wrist.

It is an objective of the present invention to provide a radial watch comprising a rigid band having a first end and a second end that form a gap therebetween sized to receive a watch case. The rigid band is monolithic and adapted to form a loop with the watch case such that the watch case is disposed on the radial side of the wrist when worn, wherein the watch case is removably secured to the second end of the band.

It is another objective of the present invention to provide a radial watch wherein the radial watch is unable to rotate around a wrist when worn.

It is yet another objective of the present invention to provide a radial watch comprising an embodiment having a support plate disposed parallel to the gap and configured to support the watch case, wherein the first end of the band is pivotally secured to a first end of the support plate and the second end is permanently secured to a second end of the support plate.

It is yet another objective of the present invention to provide a radial watch comprising a closure disposed between the first end and the second end of the rigid band, wherein the closure is adapted to open when the first end is rotated along the pivot.

It is therefore an object of the present invention to provide a new and improved radial watch that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for wearing a watch band on the radial side of a wrist. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 1:
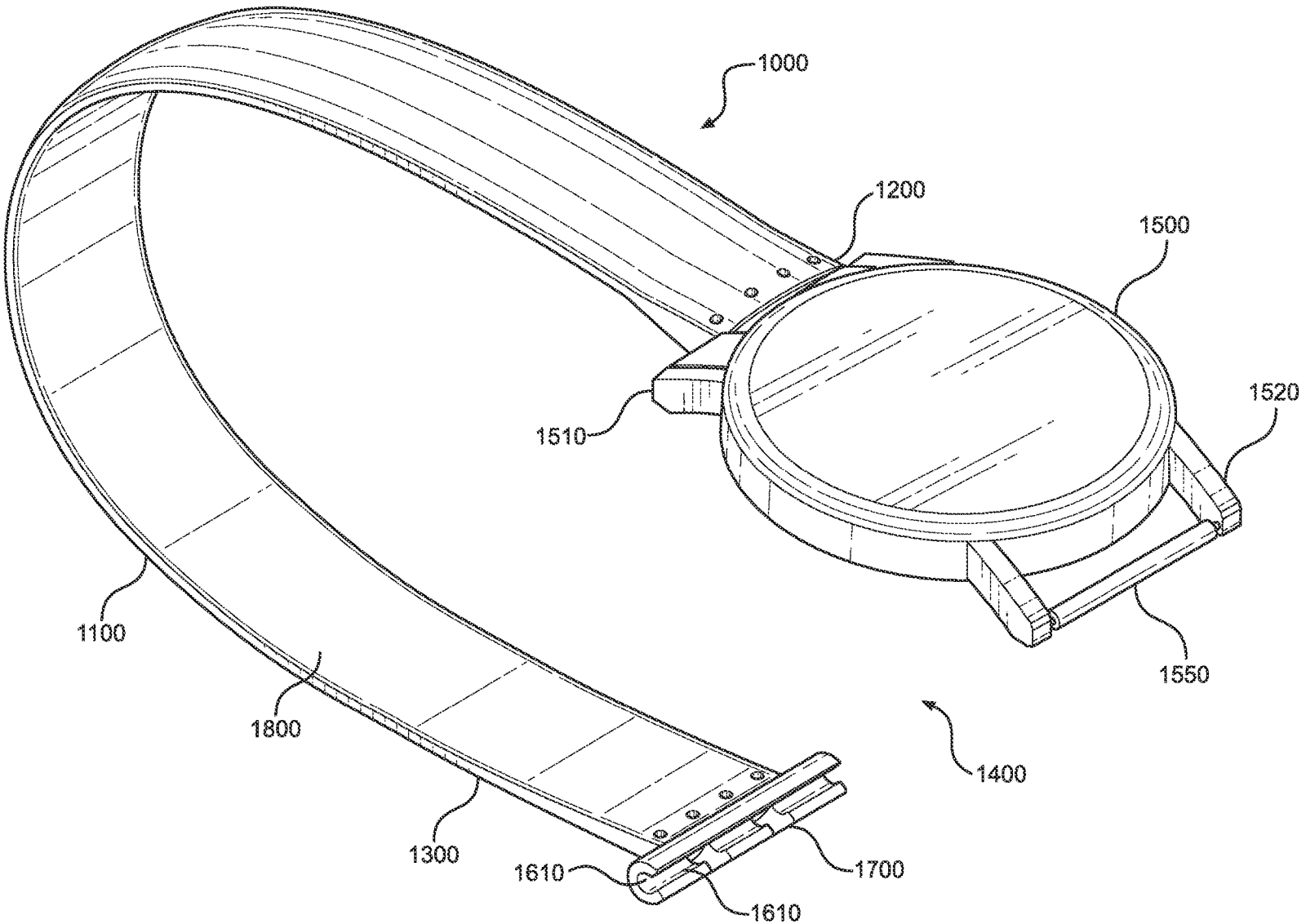
FIG. 1 shows a perspective view of an embodiment of the radial watch with a watch case in an open configuration.

Referring now to FIG. 1, there is shown a perspective view of an embodiment of the radial watch with a watch case. In the illustrated embodiment, the radial watch 1000 comprises a rigid band 1100 having a first end 1200 and a second end 1300, wherein the first and second ends 1200, 1300 form a gap 1400 therebetween. The gap 1400 is sized to receive a watch case 1500, wherein the watch case 1500 secures to the rigid band 1100 at the first and second ends 1200, 1300 thereof.

Figure 5A:
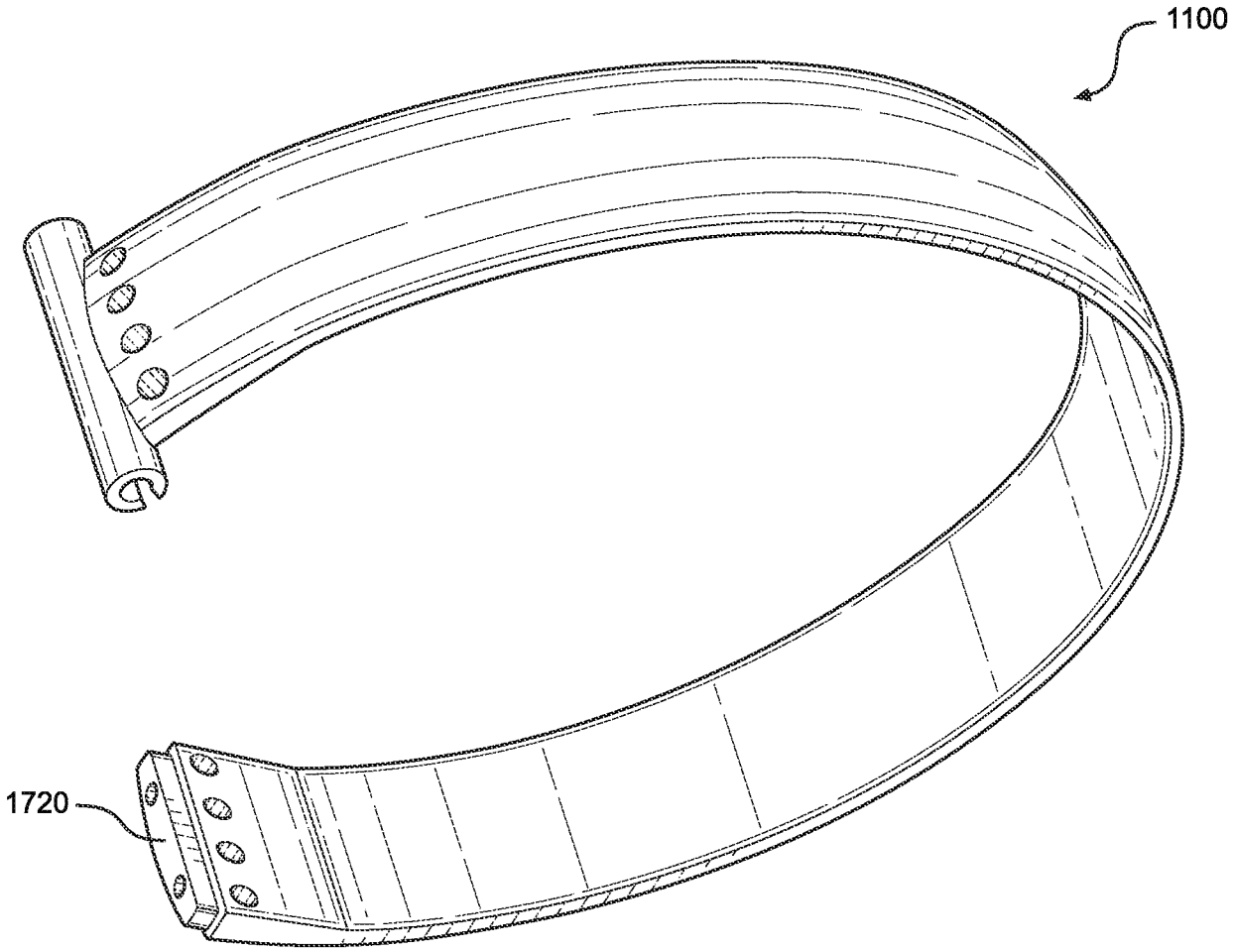
FIG. 5A shows a perspective view a second embodiment of the rigid band of the radial watch.
Figure 5B:
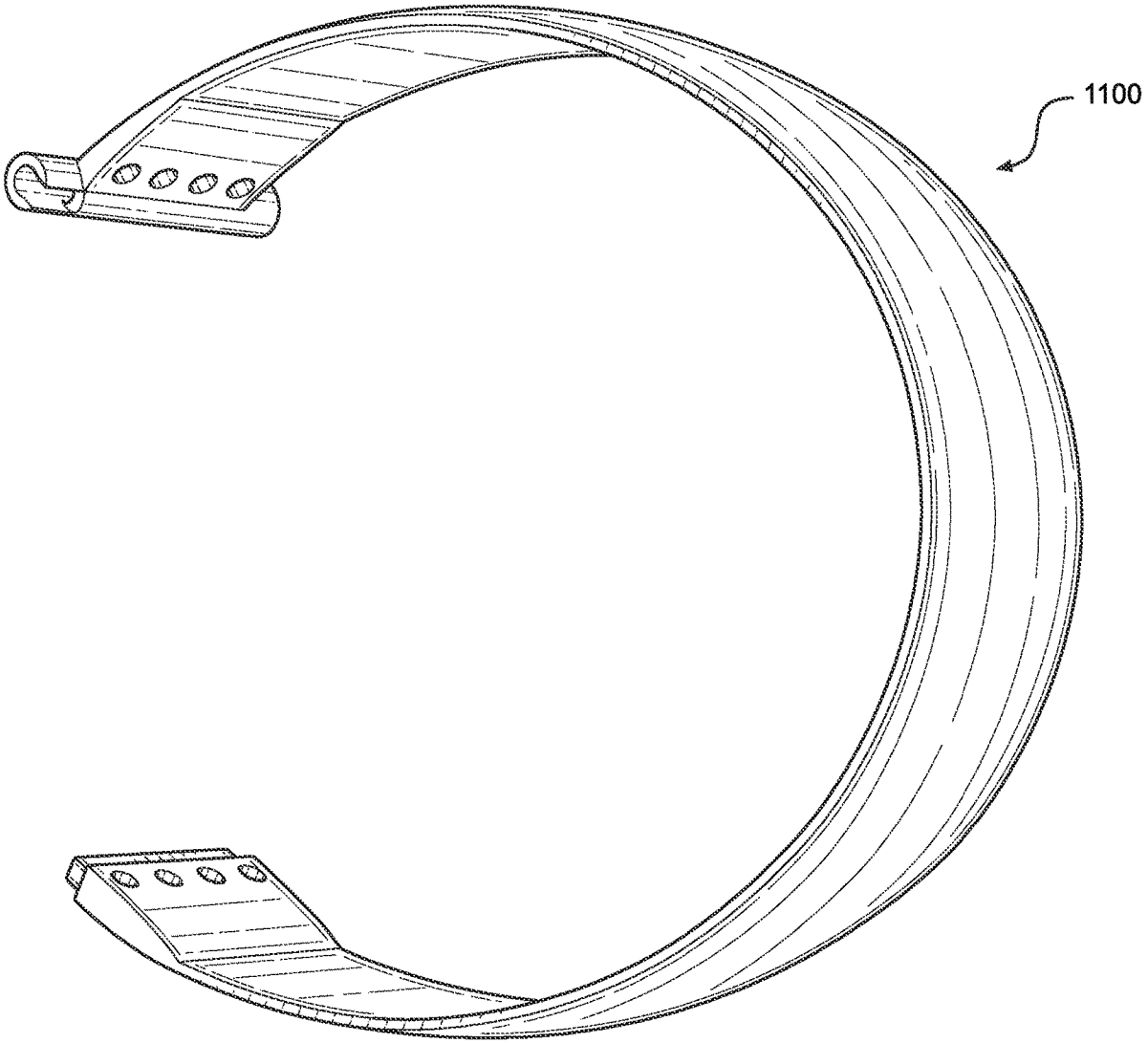
FIG. 5B shows an alternate perspective view a second embodiment of the rigid band of the radial watch.

In the illustrated, the rigid band 1100 comprises a U-shape, wherein a distance between the first and second ends 1200, 1300 forming the gap 1400 is adapted to correspond to a radial side of the wrist when worn. In other embodiments, the rigid band comprises a C-shape as shown in FIGS. 5A and 5B. The band 1100 is rigid and sized such that a wearer is unable to rotate the band 1100 when disposed around the wrist. In the illustrated embodiment, the rigid band 1100 is monolithic, wherein monolithic is defined as formed from a single piece of material without joints or seam. In other embodiments, the rigid band is formed by separate sections. In some embodiments, the radial watch 1000 comprises the watch case 1500. In other embodiments, the radial watch 1000 does not include the watch case 1500. Rigid, for purposes of this specification, means a material that is not readably deformable or able to change shape by manual (hand) manipulation. For example, the rigid band comprises a metal or alloy incapable of being bent or otherwise deflected, such that the shape is continuously maintained. In this way, the band is incapable of rotating around a user's wrist without requiring any tightening or fastening mechanism of the band.

In the illustrated embodiment, the first end 1200 of the rigid band 1100 comprises a first channel 1600 adapted to semi-permanently secure to a first end 1510 of the watch case 1500. The first channel 1600 is closed along a longitudinal axis to prevent the first end 1510 of the watch case 1500 from detaching therefrom during regular usage and wear. The longitudinal axis is disposed between opposing lateral sides of the rigid band 1100. The first channel 1600 is adapted to receive a first pin (similar to what is shown as a second pin in FIG. 1, 1550) therethrough to fasten the watch case 1500 thereto.

In the illustrated embodiment, the first channel 1600 comprises a pin extraction opening formed along a sidewall of the first channel 1600. The pin extraction opening is annular and formed along the sidewall of the first channel, which is distinct from the lateral openings of the first channel which are configured to receive the first pin therethrough. In the illustrated embodiment, the pin extraction opening terminates at the first lateral side of the rigid band, such that the remaining sidewall of the first channel is completely enclosed. The pin extraction opening is adapted to receive a small tool or fingertip to remove the first pin therefrom. In this way, the watch faces can be easily interchanged with one another.

In the illustrated embodiment, the rigid band 1100 comprises a smooth surface disposed along an interior side 1800 of the rigid band 1100. The interior side of the rigid band is defined as the side facing the wrist of the wearer when the watch band is donned. The interior side 1800 extends between the first and second ends 1200, 1300 of the rigid band 1100. In the illustrated embodiment, the band 1100 comprises a uniform width along an entire length thereof, wherein the width is measured between the lateral sides of the rigid band 1100 and the length is measured from the first end to the second end, along the rigid band 1100.

Figure 2:
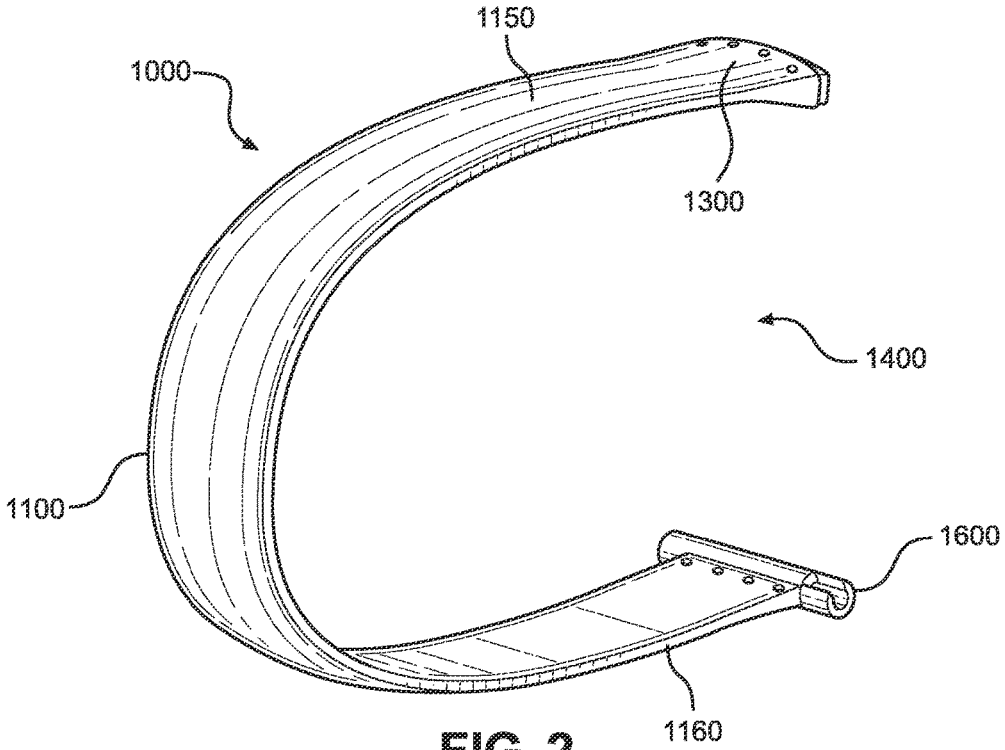
FIG. 2 shows a perspective view of an embodiment of the rigid band of an embodiment of the radial watch.
Figure 3:
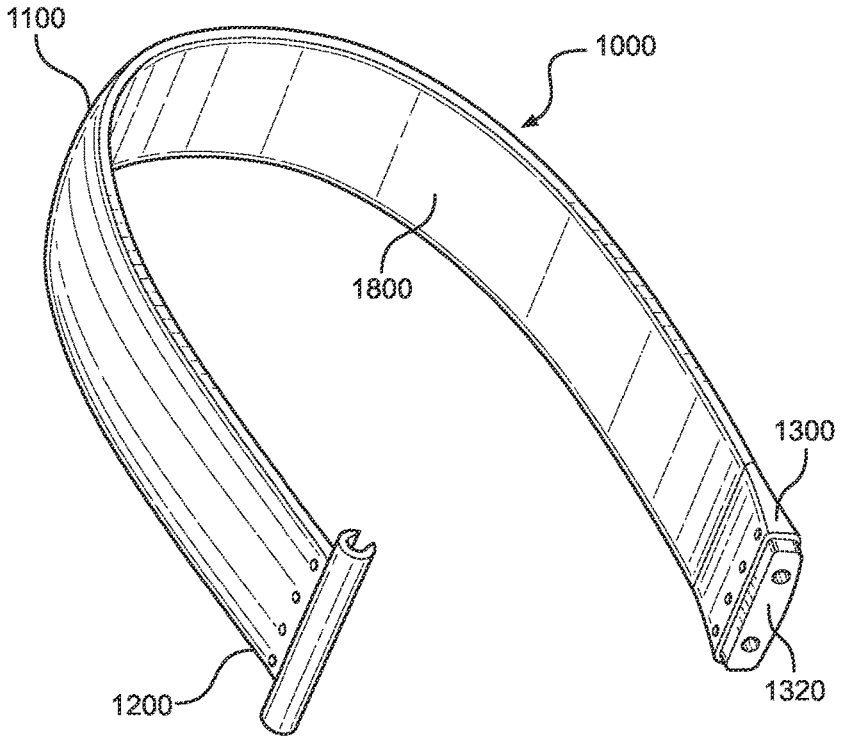
FIG. 3 shows an alternate view of an embodiment of the rigid band of an embodiment of the radial watch.

Referring now to FIGS. 2 and 3, there are shown perspective views of an embodiment of the rigid band of the radial watch. In the illustrated embodiment, the rigid band 1100 is shown without the clasp and watch face secured thereto. In the illustrated embodiment, the rigid band 1100 comprises a same width and thickness extending between the first and second ends thereof, wherein the thickness is measured between the interior and exterior side and the width is measured between the lateral sides of the rigid band 1100. In the illustrated embodiment, the rigid band 1100 gradually increases in thickness at the first and second ends (not including the protruding member 1720). In the illustrated embodiment, the rigid band 1100 comprises a U-shape, wherein a first side 1150 is substantially parallel to an opposing second side 1160. In this way, the rigid band 1100 is configured to continuously contact an upper and lower side of the user's wrist without having any gaps therebetween.

Figure 4:
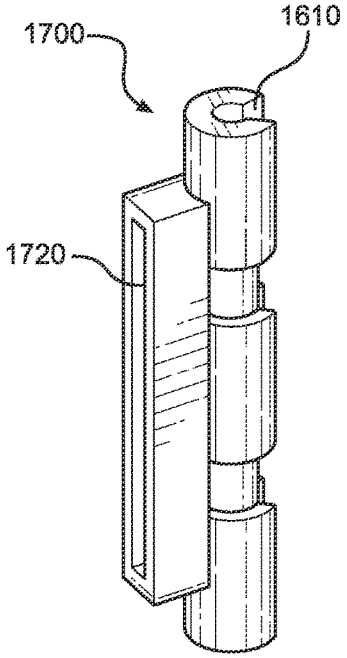
FIG. 4 shows a perspective view the clasp of an embodiment of the radial watch.

Referring now to FIGS. 1 and 4, there is the perspective view of an embodiment of the radial watch with a watch case and a perspective view the clasp of an embodiment of the radial watch, respectively. In the illustrated embodiment, a clasp 1700 is secured to the second end of the rigid band, wherein the clasp 1700 comprises a second channel 1610 that is open along a longitudinal axis. The opening of the second channel 1610 is C-shaped and faces exterior to the rigid band, wherein the second channel 1610 is configured to removably receive a second end 1520 of the watch face. In the illustrated embodiment, the second end 1520 of the watch face 1500 comprises a second pin 1550 configured to snap into the second channel 1610. Force is required to unsnap or remove the second pin 1550 from the second channel 1610. In some embodiments, the clasp 1700 comprises an open end that is disposed onto the second end 1300 of the rigid band 1100. The clasp 1700 is joined to the second end of the rigid band via any suitable fastener, such as adhesive, screws, or other mechanical fastening means. In the illustrated embodiment, the first pin and second pin are spring bars that allow the watch face to be interchanged on the rigid band.

In the illustrated embodiment, the clasp 1700 comprises a recess 1720 disposed on an end opposing the second channel of the clasp. A protruding member (as seen in FIG. 3, 1320) extends from the outermost portion of the second end of the rigid band and is insertable within the recess 1720 in an assembled configuration. In some embodiments, fasteners, such as screws, are used to secure the clasp the rigid band. In other embodiments, a friction fit secures the clasp to the rigid band.

Referring not to FIGS. 5A and 5B, there are shown perspective views of a second embodiment of the rigid band of the radial watch. In the illustrated embodiment, the rigid band 1100 is C-shaped, such that the first and second ends of the rigid band are not parallel to one another and instead form a continuous arc.

Figure 6A:
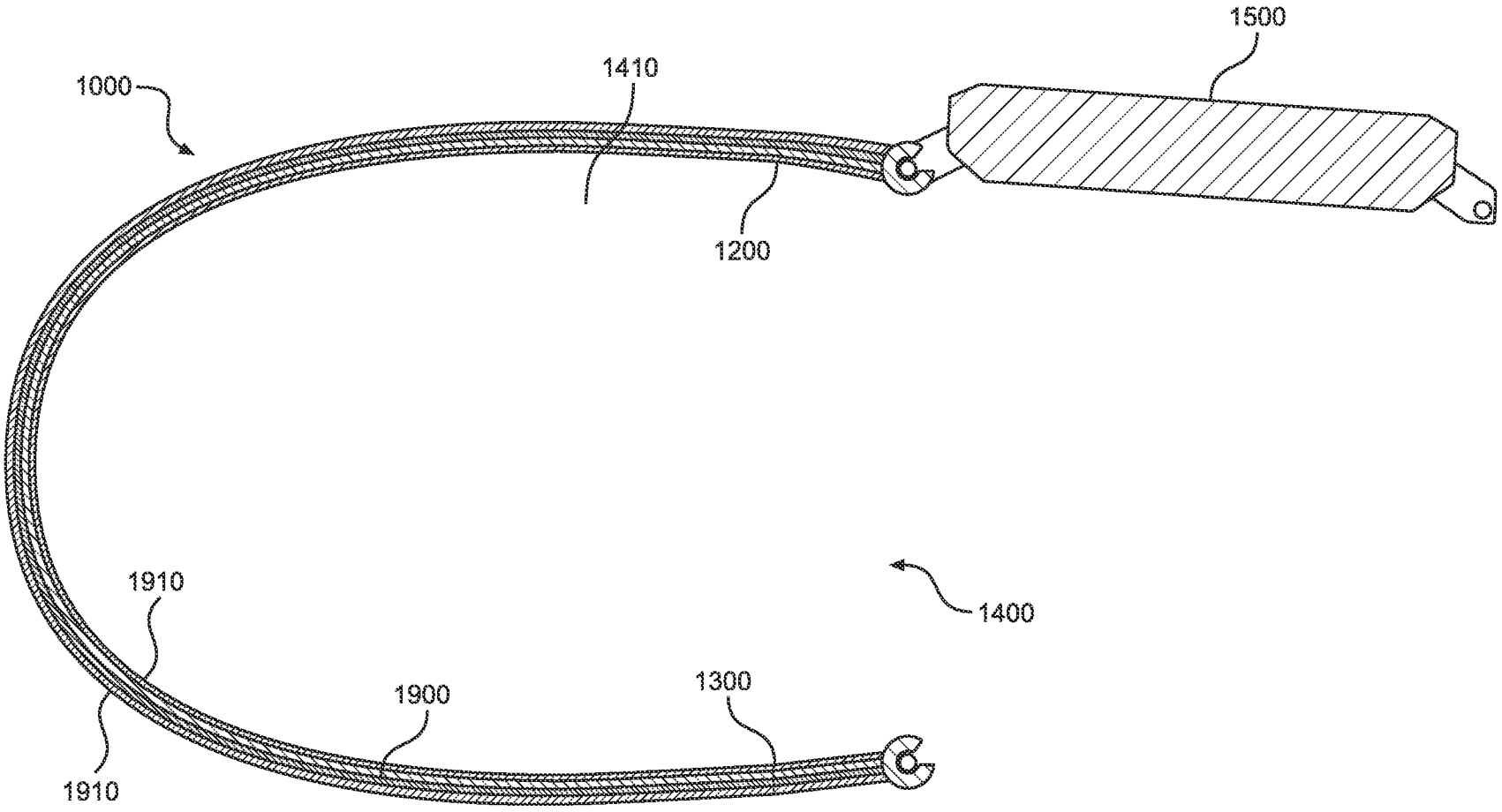
FIG. 6A shows a cross sectional view of an embodiment of the radial watch with a watch case in an open configuration.
Figure 6B:
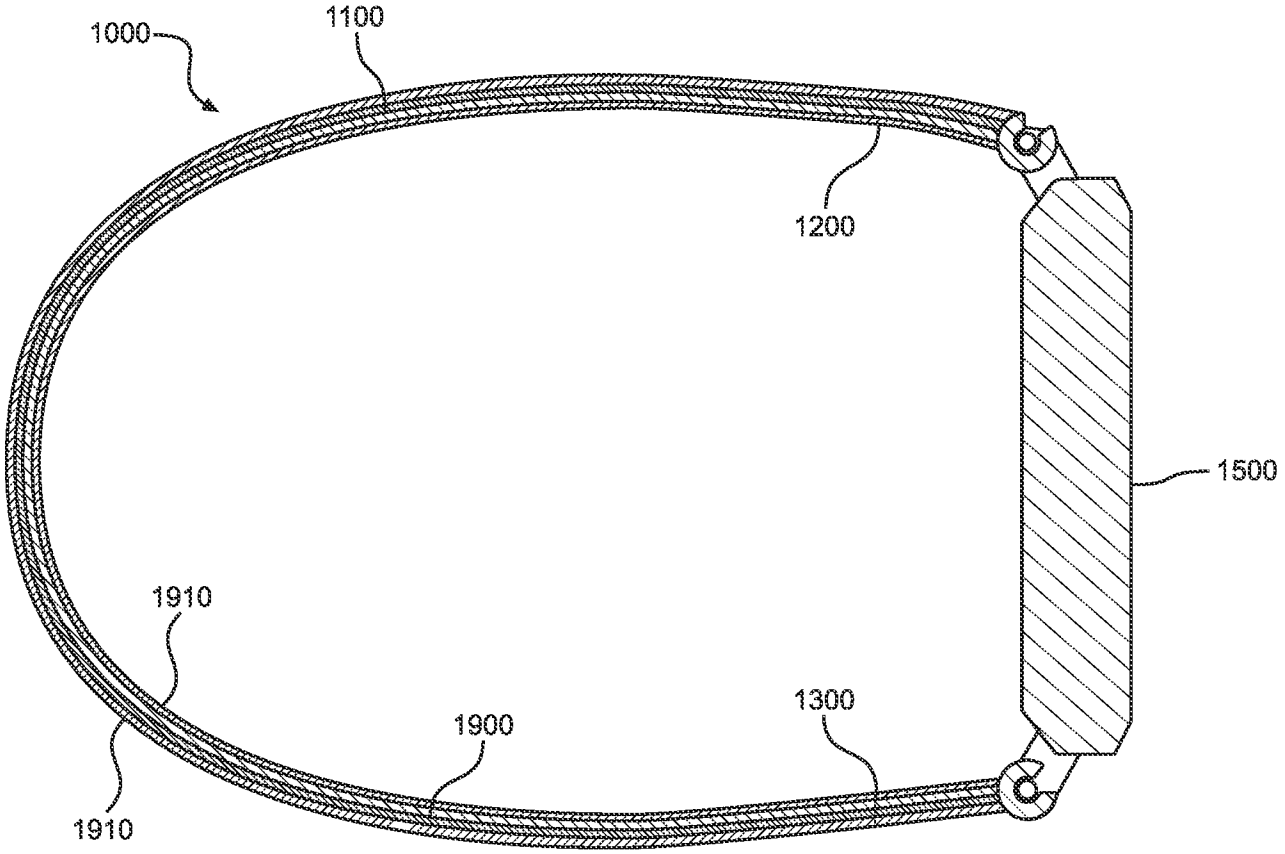
FIG. 6B shows a cross sectional view of an embodiment of the radial watch with a watch case in a closed configuration.

Referring now to FIGS. 6A and 6B, there is shown a cross sectional view of an embodiment of the radial watch with a watch case in an open configuration and in a closed configuration, respectively. In the illustrated embodiment, a layer of padding 1900 is disposed on the interior side of the rigid band 1100 to provide comfort to the wearer when the radial watch 1000 is donned. In the illustrated embodiment, the layer of padding 1900 is disposed only along an interior side of the rigid band 1100.

In the illustrated embodiment, an exterior layer 1910 is disposed entirely around the rigid band 1100 and the layer of padding 1900 to protect the rigid band 1100 and padding material from degradation. In the illustrated embodiment, the exterior layer 1910 comprises a first layer of leather sewn to a second layer of leather, wherein the first layer of leather is disposed along an exterior side of the rigid band 1100 and the second layer of leather is disposed along the interior side of the rigid band, such that a seam is positioned along the lateral sides of the rigid band 1100. In alternate embodiments the exterior layer 1910 is silicone. However, in other embodiments, the exterior layer 1910 is any suitable material configured to cover the rigid band 1100 and padding 1900.

In alternate embodiments, the radial watch does not comprise a padding layer and instead comprises a layer of material disposed entirely around the rigid band, such as a layer of silicone rubber. In some embodiments, the radial watch comprises the padding on the interior side and a layer of silicone rubber disposed entirely around the rigid band.

The radial watch 1000 with the watch case 1500 is movable between a closed and open configuration. In the open configuration, the wearer is able to remove or insert his or her wrist through the gap 1400 and into a central aperture 1410 of the band 1100 of the band 1000. In the closed configuration, both ends of the watch case 1500 are secured to the rigid band 1100, forming a closed loop.

Figure 7:
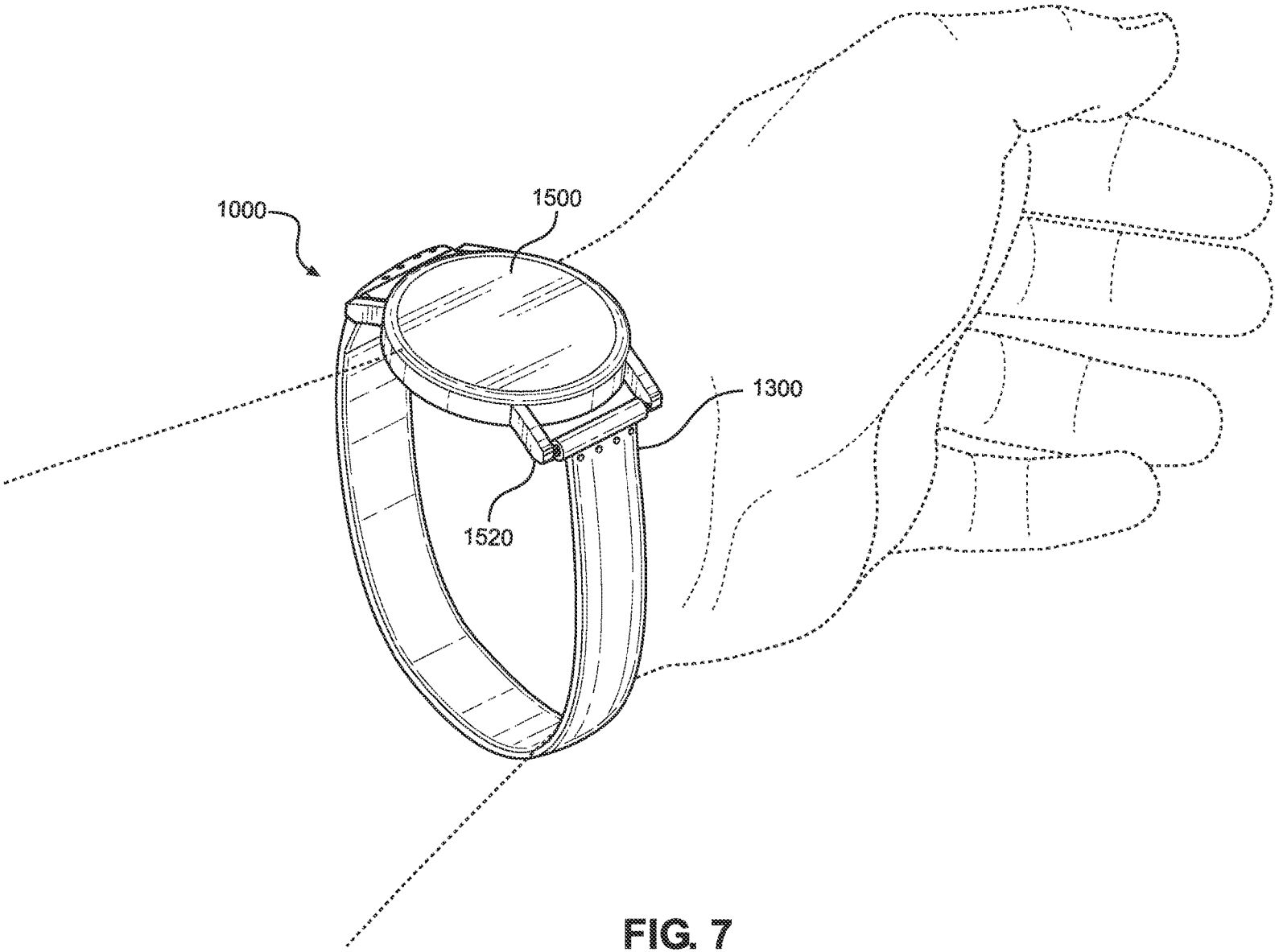
FIG. 7 shows a perspective view of an embodiment of the radial watch with a watch case in use.
Figure 8:
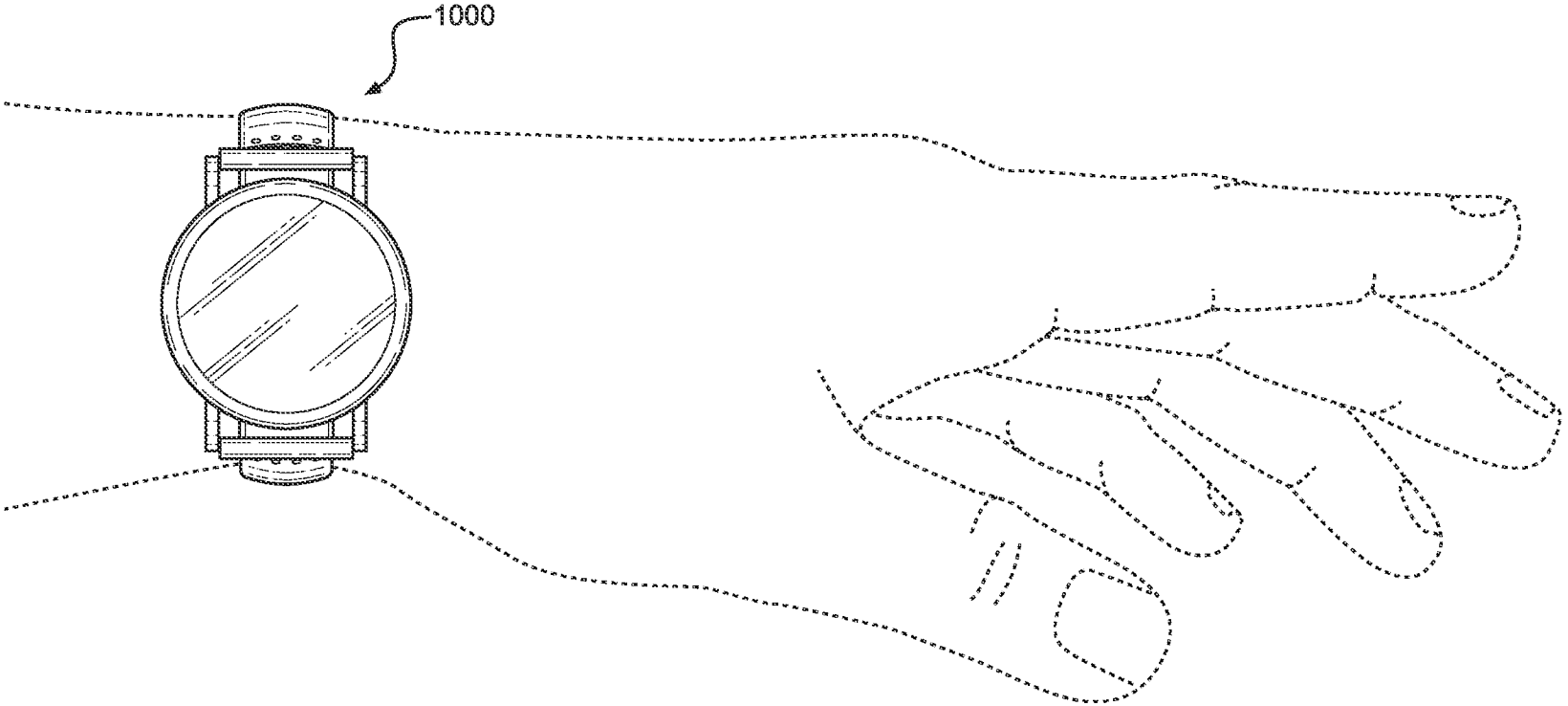
FIG. 8 shows an alternate perspective view of an embodiment of the radial watch with a watch case in use.

Referring now to FIGS. 7 and 8, there are shown perspective view of an embodiment of the radial watch with a watch case in use. In operation, the wearer dons the radial watch 1000 by unfastening or unsnapping the second end 1520 of the watch face 1500 from the second end 1300 of the rigid band 1100. The watch case 1500 is pivotable about the first end 1200 of the band 1100 and configured to rotate away from the band 1100, thereby allowing a wearer to insert the wrist through the gap formed between the ends of the band. In a worn configuration, the rigid band forms a loop with the watch case such that the watch case is disposed on the radial side of the wrist. The rigidity and U-shape of the rigid band prevents the radial watch 1000 from rotating around a wrist when worn because the rigid band fits closely to the wrist.

In some embodiments, the radial watch comprises the rigid band and a plurality of watch faces that are interchangeably securable to the rigid band. In other embodiments, the rigid band is configured to receive a pre-existing watch face configured to fit within a predetermined gap size. A method of fitting the rigid band to a wearer's wrist and a pre-existing watch face comprise obtaining the height and the width of the wrist on which the radial watch will be worn. A make and model of the wearer's watch face or height and width measurements of the watch face are obtained. A watch lug (also referred to as a watch horn) width and watch spring bar width of the pre-existing watch face is measured. The rigid band width, height, and gap size are manufactured to correspond to the pre-existing watch face measurements. In some embodiments, the rigid band is customized via computer numerical control machine services.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A radial watch, comprising:

a rigid band having a first end and a second end, wherein the first and second ends form a gap therebetween sized to receive a watch case, the watch case pivotally secured to the first end of the rigid band;

wherein the first end comprises a closed first channel adapted to secure to a first end of the watch case;

a clasp disposed on the second end of the rigid band, wherein the clasp comprises a second channel open along a longitudinal axis to removably receive a second end of the watch case;

wherein the second end of the rigid band comprises a protruding member adapted to be received by a recess of the clasp, wherein the recess is disposed on an end of the clasp opposing the second channel of the clasp;

wherein the rigid band is monolithic;

wherein the rigid band is adapted to form a loop with the watch case such that the watch case is adapted to be disposed on a radial side of the wrist when worn thereon;

wherein a worn configuration, the watch case is positioned between a palm side and a dorsal side of the wrist and the rigid band prevents the watch case from rotating to the palm side or the dorsal side.

2. The radial watch of claim 1, wherein the rigid band is composed of an alloy.

3. The radial watch of claim 1, wherein the rigid band is U-shaped such that a first side of the rigid band is adapted to rest on the palm side of the wrist and a second side of the rigid band is adapted to rest on an opposing dorsal side of the wrist, wherein the gap of the rigid band is adapted to align with the interior radial side of the wrist when worn.

4. The radial watch of claim 3, wherein the rigid band rests against the ulnar side of the wrist in the worn configuration and the first and second ends of the rigid band extend into the radial side of the wrist, wherein the watch case is positioned on the radial side such that the radial watch cannot freely rotate about the wrist in a closed configuration.

5. The radial watch of claim 1, wherein the rigid band comprises a layer of padding disposed only along an interior side thereof.

6. The radial watch of claim 5, wherein an exterior layer is disposed entirely around the rigid band and the layer of padding.

7. The radial watch of claim 6, wherein the watch case is pivotally secured to the first end of the rigid band and removably securable to the second end of the rigid band via a watch fastener.

8. The radial watch of claim 7, wherein the watch case comprises a first pin is disposed along a width of the watch case and permanently secured within the first channel.

9. The radial watch of claim 8, wherein the watch fastener comprises a second pin disposed along a width of the watch case that is removably received by the second channel.

10. The radial watch of claim 9, wherein a partially open configuration only one end of the watch fastener is secured to either the first end or the second end of the watch band.

11. The radial watch of claim 1, wherein the radial watch comprises a first watch face that is interchangeable with a second watch face.

* * * * *